US005314088A

United States Patent [19]

Heuberger et al.

[11] Patent Number: 5,314,088

[45] Date of Patent: May 24, 1994

[54] CARDBOARD PACKAGING FOR LIQUIDS

[75] Inventors: Erich Heuberger, Trugenhofen; Wolf-Dieter Knörrich; Joachim W. Dziallas, both of Heidenheim; George Plester, Essen; Georg Troska, Herten, all of Fed. Rep. of Germany

[73] Assignees: The Coca-Cola Company, Atlanta, Ga.; Carl Edelmann GmbH, Heidenheim, Fed. Rep. of Germany

[21] Appl. No.: 849,071

[22] PCT Filed: Aug. 16, 1991

[86] PCT No.: PCT/EP91/01563

§ 371 Date: Apr. 22, 1992

§ 102(e) Date: Apr. 22, 1992

[87] PCT Pub. No.: WO92/03352

PCT Pub. Date: Mar. 5, 1992

[30] Foreign Application Priority Data

Aug. 22, 1990 [DE] Fed. Rep. of Germany ..... 4026562

[51] Int. Cl.[5] ..... B65D 5/74; B65D 5/56

[52] U.S. Cl. ..... 220/465; 53/172; 53/175; 220/418; 220/462; 493/93; 493/907

[58] Field of Search ..... 220/403, 408, 410, 416, 220/418, 461, 462, 465; 53/172, 175, 410, 449; 493/93, 100, 101, 907

[56] References Cited

U.S. PATENT DOCUMENTS

| | | | |
|---|---|---|---|
| 2,089,483 | 8/1937 | Jaenicke | 53/449 |
| 2,454,919 | 11/1948 | Hagan . | |
| 2,979,247 | 4/1961 | Pellaton et al. | 220/462 |
| 3,208,658 | 9/1965 | Membrino | 220/462 |
| 3,226,002 | 12/1965 | Walker . | |
| 3,269,635 | 8/1966 | Bergstein et al. | 53/449 |
| 3,459,357 | 8/1969 | Egger et al. | 53/449 |
| 3,539,360 | 11/1970 | Wood | 493/100 |
| 3,561,667 | 2/1971 | Saltman | 220/462 |
| 3,576,290 | 4/1971 | Marchison | 220/462 |
| 3,577,699 | 5/1971 | Silver | 53/449 |
| 4,174,051 | 11/1979 | Edwards et al. . | |
| 4,478,351 | 10/1984 | Homma | 220/462 |
| 4,560,090 | 12/1985 | Okushita . | |
| 4,890,772 | 1/1990 | Heuberger et al. | 220/462 |

FOREIGN PATENT DOCUMENTS

| | | | |
|---|---|---|---|
| 3430071 | 4/1973 | Australia . | |
| 1120355 | 12/1961 | Fed. Rep. of Germany . | |
| 359094 | 1/1962 | Fed. Rep. of Germany . | |
| 1162271 | 1/1964 | Fed. Rep. of Germany . | |
| 1461762 | 8/1970 | Fed. Rep. of Germany . | |
| 1786219 | 1/1972 | Fed. Rep. of Germany . | |
| 3541010 | 10/1986 | Fed. Rep. of Germany . | |
| 8532685 | 3/1987 | Fed. Rep. of Germany . | |
| 3802793 | 8/1989 | Fed. Rep. of Germany . | |
| 3836069 | 12/1989 | Fed. Rep. of Germany . | |
| WO9203352 | 3/1992 | PCT Int'l Appl. . | |
| 904471 | 8/1962 | United Kingdom . | |
| 1432450 | 4/1976 | United Kingdom | 53/449 |
| 2117736 | 10/1983 | United Kingdom . | |
| 8902395 | 3/1989 | World Int. Prop. O. | 220/403 |

OTHER PUBLICATIONS

European Search Report.

*Primary Examiner*—Gary E. Elkins

*Attorney, Agent, or Firm*—Birch, Stewart, Kolasch & Birch

[57] ABSTRACT

There is provided a cardboard packaging for liquids which consists of a folding box, an inner bag arranged therein and made from a plastic material, and of a withdrawal nozzle which is accessible from the outside through a hole formed in one wall of the folding box. The withdrawal nozzle comprises a base plate which is welded or bonded in liquid-tight fashion to the bag at the inner side of said bag in a weldless area thereof. The inner bag is only bonded to and easily detachable from the folding box wall that includes the hole for the withdrawal nozzle, but, apart from this, is not bonded to the walls of the folding box. The withdrawal nozzle is therefore secured against rotation, and the bag is sufficiently fixed in the folding carton. In addition, it can easily collapse during emptying, and the packaging can be easily disassembled into its cardboard and plastic parts after use (FIG. 2 ).

11 Claims, 4 Drawing Sheets

CARDBOARD PACKAGING FOR LIQUIDS

This invention relates to a cardboard packaging which is used for liquids and consists of a folding box, an inner container arranged therein and made from a plastic material, and of a withdrawal nozzle which is accessible from the outside through a hole formed in one wall of the folding box. Such a cardboard packaging is e.g. known from German patent application 38 02 793.

Packagings of this type are used as nonreturnable packagings and intended as a substitute for bottles or containers made of plastics, glass or sheet metal. Their main purpose consists in facilitating their disposal after use. The folding box guarantees the necessary stability, while the inner container ensures a tight sealing of the liquid contained therein.

As for the packaging known from the above-mentioned publication, the inner container consists of a flexible plastic bag which after production must be inserted into the erected folding carton. The delivery of the packaging in the finished state to the filling company necessitates the transportation of empty containers having a relatively large volume, which is not economical. However, when the individual parts thereof are sent separately—the outer carton may here be in a flat state, the inner container must first be inserted by the filling company into the folding box to be erected at the filling plant. Difficulties arising therefrom consist in that when the inner container is introduced into the folding box, the air contained in this box must be removed. Moreover, the withdrawal nozzle must be suitably positioned on the folding box in such a way that it does not rotate during opening or closing if it is not held by hand during these operations. As a result, the packaging is relatively difficult to handle and uneconomic on the whole.

It is the object of the present invention to provide a cardboard packaging of the above-mentioned type which can be produced easily and handled in a space-saving way up to the filling operation and, nevertheless, has the advantage that the inner container can collapse in the folding carton during emptying so as to prevent the contents thereof from coming into contact with air prior to withdrawal, and it should here not be necessary to hold the withdrawal nozzle separately during the screwing or unscrewing of a screw cap or a withdrawal fitting.

Figure 1:
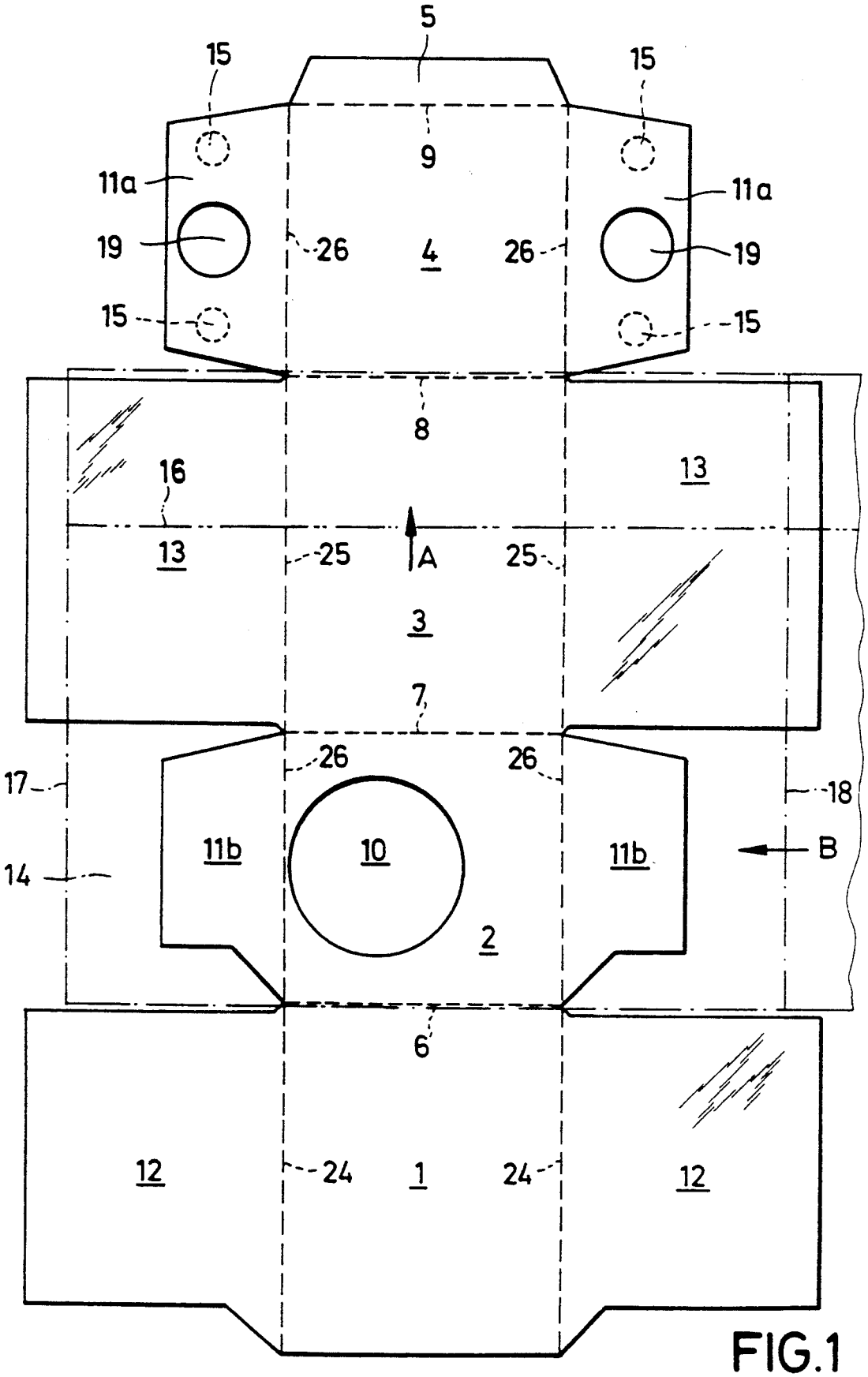
Figure 2:
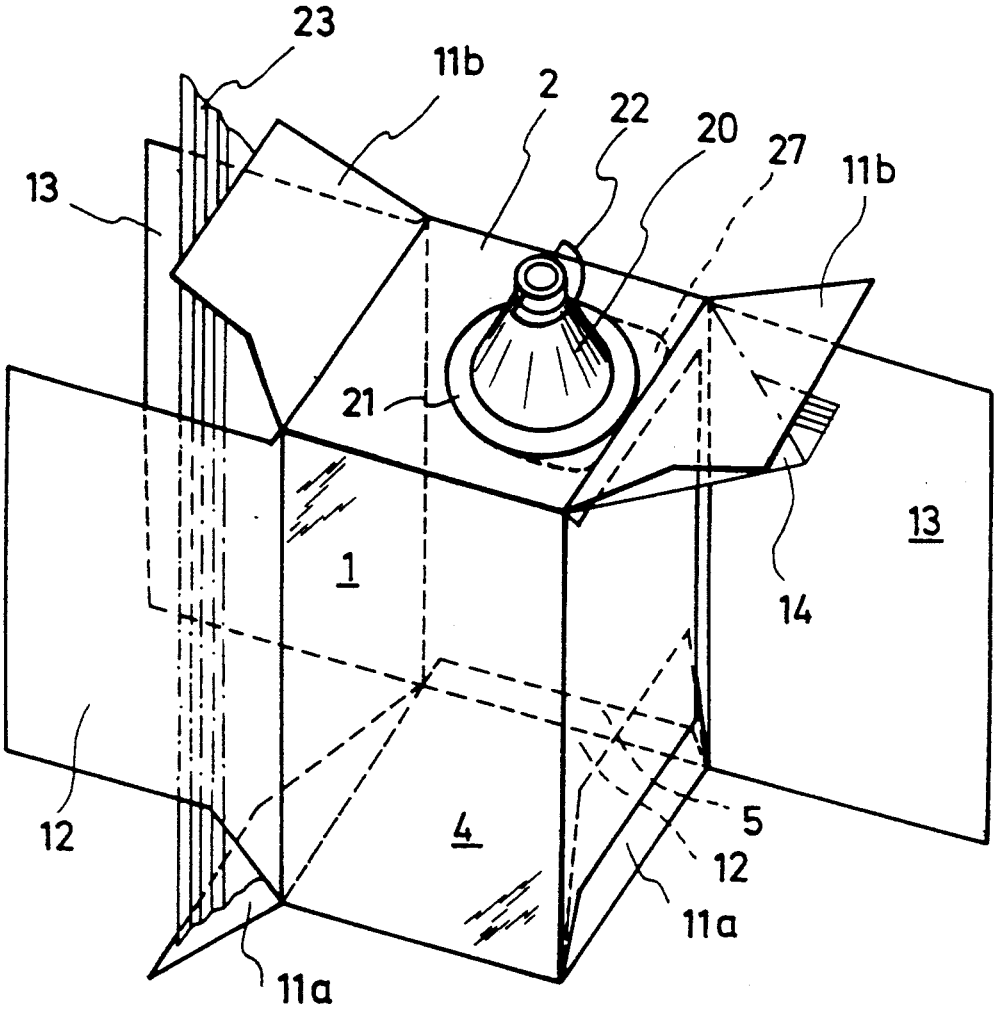
Figure 3:
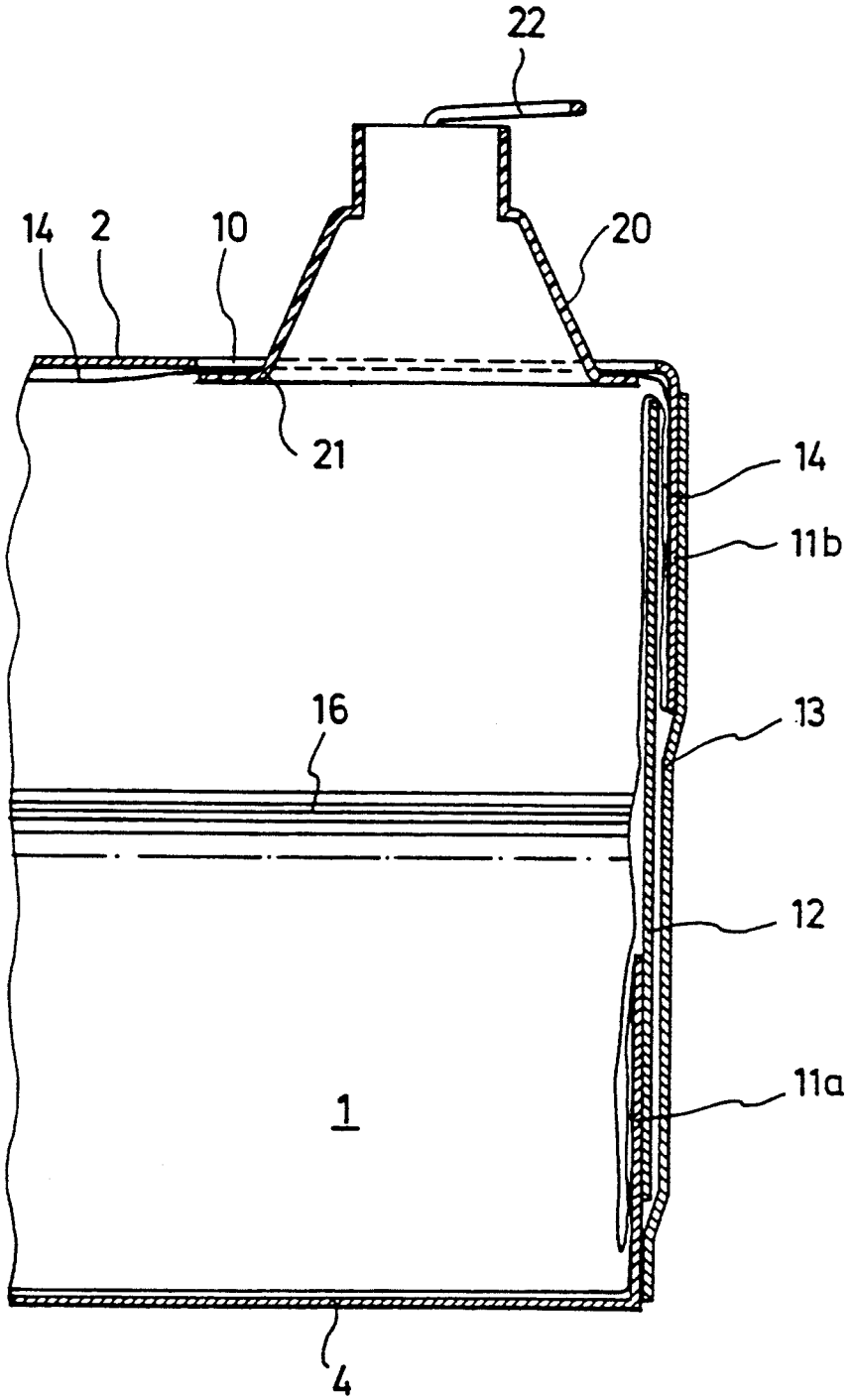
Figure 4:
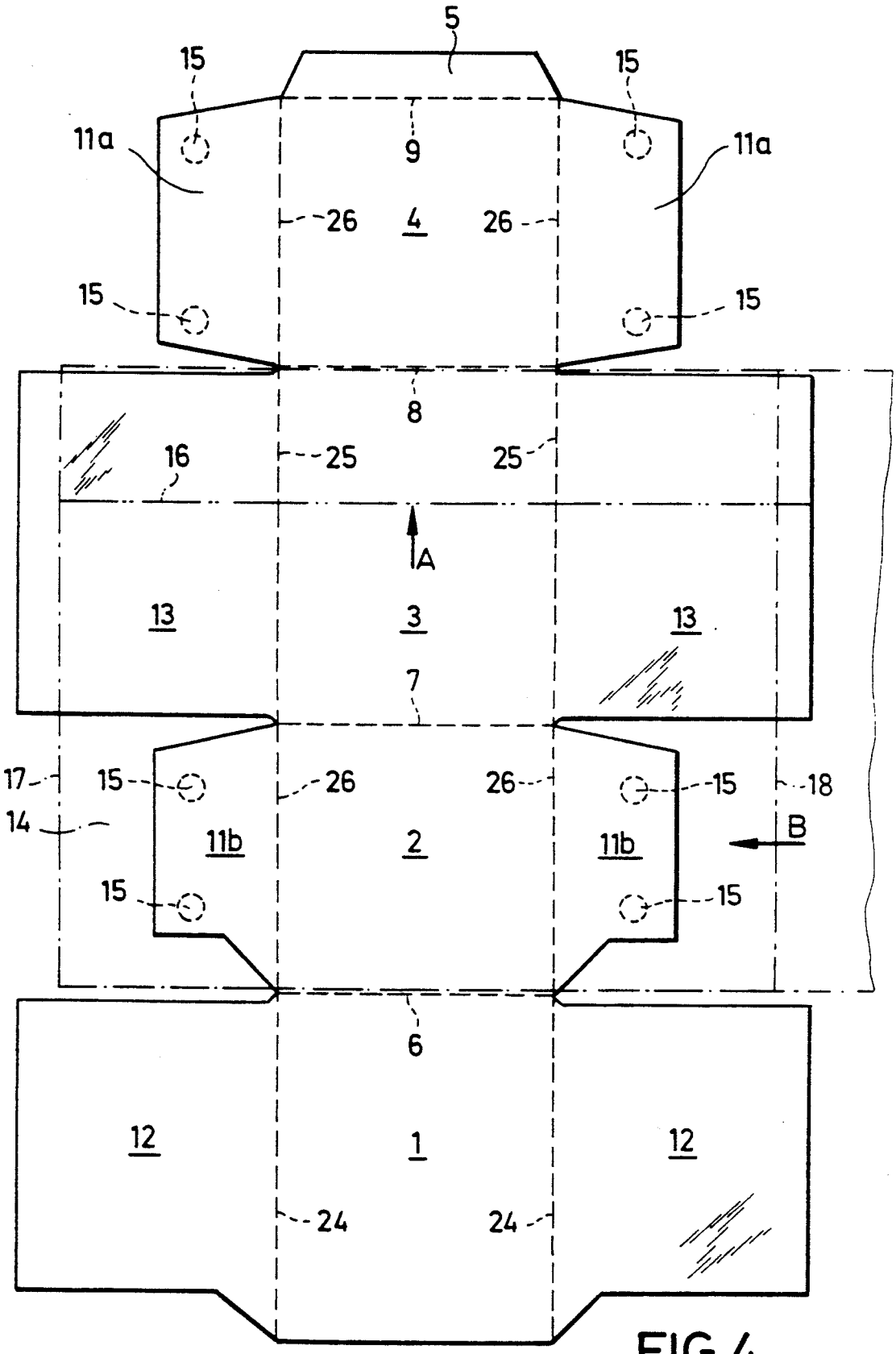

The invention, its features and advantages, as well as the method of making and handling the cardboard packaging in the production and filling processes shall now be explained in greater detail with reference to an embodiment illustrated in the drawings, in which FIG. 1 shows a developed blank as a part of the cardboard packaging;

FIG. 2 a perspective view of the cardboard packaging with an inner bag disposed therein, in the partly closed state of the folding carton;

FIG. 3 a detail of a vertical section through the packaging of FIG. 2—approximately actual size; and FIG. 4 a developed blank of a cardboard packaging in accordance with a simplified embodiment of the invention.

As shown in FIG. 1, the blank for the packaging of FIG. 2 substantially consists of four sections 1, 2, 3 and 4 arranged one after the other in the direction of arrow A, and of an adhesive tab 5 bordering on one end thereof, with the individual members being separated from one another by transversely extending folding lines 6, 7, 8 and 9. In the erected state of the folding box said four sections 1–4 form four complete walls of the box. One of the sections—in the present case section 2—has a circular hole through which a withdrawal nozzle can enter.

Two sections that are not adjacent—in the illustrated embodiment sections 2 and 4—are continued by lateral flaps 11*a* and 11*b*, respectively, which have a width measured in a direction transverse to the direction of arrow A, i.e. in the direction of arrow B, which is at the most half as great as the length of section 1 and 3, respectively, measured in the direction of arrow A. In the direction of arrow A flaps 11*a* have substantially the same dimensions as section 4, on which they are mounted, while in the direction of arrow A flaps 11*b* have predominantly smaller dimensions than section 2, on which they are mounted, as they are provided with cutouts. The reason for this reduced size will be explained later.

One of the other sections—in the present embodiment section 1—is laterally continued by flaps 12 which in the direction of arrow B have a width corresponding approximately to the width of sections 1–4, which is measured in the same direction. In the direction of arrow A, however, they are predominantly of a size smaller than that of sections 1 and 3 on account of cutouts. The reason for this reduced size shall also be explained later. Section 3 is laterally continued by flaps 13 whose dimensions in direction B are about the same as those of sections 2 and 4 in direction B. In direction A flaps 13 have about the same dimensions as sections 1 and 3.

As shown in FIG. 2, the inner bag 14 consists of a portion of a plastic tube which during the manufacture of the packaging is placed in area contact with the blank in direction B and bonded by means of a pressure-sensitive or hot-melt adhesive to section 2 over substantially the whole surface thereof. When being measured in direction A, the tube in its flat state has a width which is about half the entire extension of sections 1–4 in direction A. In this way the clear cross-section of the inner bag 14 made from the tube portion corresponds approximately to that of the folding carton in the erected state of the packaging. In the area of hole 10 the tube may already be provided with a corresponding opening before being placed onto the blank. This opening rests above the hole 10 when the tube is positioned on the blank.

The tube may be made from a flat film web welded in the longitudinal direction. The weld, however, extends in an area adjacent section 2, which is marked in FIG. 1 by a line 16 drawn with two dashes and two dots. The longitudinal portion of the tube which belongs to an individual blank is marked in FIG. 1 by front and rear boundary lines 17 and 18, respectively.

During the manufacture of the packaging, and after the tube has been placed on and fastened to the blank, the tube portion intended therefor is separated at the rear cutting line 18 from the remaining tube material. Subsequently, the two outer sections 1 and 4 are bent over onto the remaining blank and the tube portion. Flaps 11*a* provided on section 4 may optionally be bonded to the tube portion with the aid of pressure-sensitive or hot-melt adhesive patches 15, and the adhesive tab 5 is bonded to section 1. In this state the inner bag 14 made from the tube portion is open at both cutting edges 17 and 18.

In this flat prebonded state the blank can be delivered in a space-saving way to the filling company.

To finish the packaging, the prepared blank provided with the open inner bag 14 is erected to obtain a tubular body of a rectangular cross-section with the aid of a conventional erecting machine. The adhesive bond provided by the adhesive patches 15 helps to erect the inner bag 14 in the blank, i.e the open inner bag 14 is automatically erected because it is bonded to the blank.

Instead of or in addition to the use of adhesive patches 15, flaps 11*a* may alternatively be provided with holes 19 through which the inner bag 14 is accessible from the outside to suction applying means of an erecting machine whose suction means rest on the inner bag 14 for erecting the folding box and thus erect the folding box in a manner which is known per se. With this alternative the adhesive patches 15 can be dispensed with.

Subsequently, a prepared withdrawal nozzle 20 is introduced from one of the open sides of the inner bag 14 into the inner space of the open packaging. Unless the inner bag 14 was not previously provided with an opening in the area of the hole 10, the inner bag 14 is circularly punched in the area of hole 10 prior to or simultaneously with the introduction of the withdrawal nozzle 20.

The withdrawal nozzle 20 has a base plate 21 which is connected in liquid-tight fashion to the inner bag 14, e.g. with the aid of a hot-melt adhesive or by direct welding, from the inside. The withdrawal nozzle 20 may be a flexible nozzle which can be pushed into the packaging in the manner of bellows, so that it does not protrude therefrom prior to use. Hence, to be able to remove the nozzle from the packaging for making use of the same, this nozzle is expediently provided with a handle 22.

After the introduction and mounting of the withdrawal nozzle 20 the optional adhesive bonds provided on the adhesive patches 15 between the inner bag 14 and flaps 11*a* are detached, and the inner bag 14 is sealed along the cutting edges 17 and 18 by welding. The welds are designated with reference numeral 23 in FIG. 2. It is necessary to detach the above-mentioned adhesive bonds on the adhesive patches 15 (if they exist) in order to be able to carry out the welding operation and, above all, to allow the inner bag 14 to collapse in an unhindered way in the folding carton when the contents thereof is discharged later.

After the welds have been made, the lateral portions of the inner bag 14, which can be seen in FIG. 2 at the lower end of the inner bag 14, are folded in and flaps 11*a* are then the first members that are bent in. Attention must here be paid that the respectively adjacent, folded gores of the inner bag 14 come to rest entirely in the folding box. This state is shown in FIG. 2 at the right lower end of the packaging. Flaps 12 which have smaller dimensions are then pivoted onto flaps 11*a*. For this purpose folding lines 24 (FIG. 1) are provided between section 1 and flaps 12. Attention must here be paid that the other gores of the inner bag, of which one can be seen in FIG. 2 at the right side, top, below flap 11*b*, protrude from the folding box.

Flaps 11*b* are then folded down together with the underlying inner bag gores onto flaps 12, and the big flaps 13 are subsequently folded as cover flaps onto the already folded, partly overlapping flaps 11*a*, 12 and 11*b*.

Since on account of their small dimensions flaps 11*b* and 12 are not as high as sections 1–4 which determine the height and depth of the packaging, an adhesive can respectively be applied to all of the above-mentioned flaps 11*b*, 12 and 11*a* below the edge portion of flaps 13. After the adhesive has been applied to these exposed areas and the areas of the flaps 12 which are adjacent the folding lines 24, flaps 13 are bent around folding lines 25 (FIG. 1) onto flaps 11*a,b* and 12 and bonded thereto. This results in a dimensionally stable folding carton whose inner space is entirely sealed to the outside. There remains no gap below flaps 13 through which foreign matter could penetrate into the space between the inner bag and the folding carton.

The packaging can now be filled through the withdrawal nozzle. After the latter has been closed and possibly punched into the packaging, the hole 10 can be closed with an adhesive seal as a warranty closure.

In the illustrated embodiment the withdrawal nozzle is asymmetrically mounted, with hole 10 extending up to the vicinity of one of the folding lines 26 that separate flaps 11*b* from section 2. Alternatively, it is also possible to provide hole 10 at a somewhat greater distance from the folding line 26, in particular in the middle of section 2. An eccentric mounting, however, helps to empty the packaging completely.

The bonding between the inner bag 14 and section 2, and the bonding between flange 21 and the inner bag 14 prevent the withdrawal nozzle 20 from rotating when a screw cap or connection fitting is screwed or unscrewed. Another safety measure against rotation may consist in providing flange 21 of the withdrawal nozzle with at least one lateral extension 27 (FIG. 2) which extends up to an edge of section 2 and is supported on the subsequent flap 11*b* and the adjacent carton section 1 or 3. This extension 27 of flange 21 also helps to position the withdrawal nozzle 20 when the latter is inserted into and mounted onto the packaging.

The tube portion which is arranged in the folding carton and constructed such that an inner bag 14 is obtained can be seen in FIG. 3 showing a longitudinal section. In the illustrated embodiment the tube portion comprises a longitudinal weld 16 which extends next to one of sections 1 and 3. In the area of section 2 in which hole 10 for the withdrawal nozzle 20 is formed, the inner bag 14 is thus without any welds. As a consequence, the tight seal between flange 21 of the withdrawal nozzle 20 and the material of the inner bag 14 is not impaired. Furthermore, the folded portions (gores) of the inner bag 14 can be seen in FIG. 3 at one side. As for the thicknesses of the materials, FIG. 3 is not true to scale. It is only to show how the flaps are folded onto one another, with the inner bag gores that are adjacent the withdrawal nozzle 20 being enclosed between the bent flaps 11*b* and 12.

The reason for the last-mentioned measure shall now be explained. The illustrated packaging is meant to be emptied in an upside-down position, i.e. with the withdrawal nozzle facing downwards, preferably with the aid of a suction device. Tests have shown that certain amounts of liquid remain in the gores of the inner bag and cannot be removed despite the application of a suction force. When these gores that are at the bottom in the use position of the packaging are enclosed between the above-mentioned flaps 11*b* and 12, the liquid volume that can be taken up by them is negligibly small. At the same time, these gores are fixed in position, so that they cannot hinder the emptying process. A comparable positioning of the other gores is not advisable, as the inner bag could otherwise not collapse during the emptying process. To prevent an undesired absorption of liquid by these gores, said last-mentioned gores may respectively be sealed—during welding of the inner bag—by a transverse weld which approximately extends at that place where the respective gore protrudes from the semiclosed folding box during manufacture of the packaging.

For the sake of clarity, threads or bayonet coupling portions on the withdrawal nozzle 20 are not shown in the drawing because they are not necessary for the explanation of the invention. Moreover, none of the adhesive bonds is shown in FIG. 3 for reasons of an improved depiction although, as has been explained, an adhesive layer is provided between section 2 of the folding box and the inner bag 14.

An important feature of the present invention is that the film tube portion which later forms the inner bag is detachably bonded to the flaps of the prebonded folding box blank by means of individual adhesive patches which during the erection of the blank serve to carry along the film tube portion which is in its flat state and still unclosed, i.e. they help to erect the same. Furthermore, it is important that during closing of the film tube portion said adhesive patches are detached for forming an inner bag. This feature of the invention can be employed irrespective of the presence of a withdrawal nozzle with base plate and irrespective of any bonding of the film tube portion to the blank in the area of one of the sections forming the folding box body.

FIG. 4 shows a developed blank with a film tube of such a simplified embodiment. Unlike the embodiment illustrated in FIG. 1, film tube 14 of this embodiment is not bonded to section 2 pertaining to the folding box body, but to the adjacent flaps 11*b* on adhesive patches 15 and, after the other body sections 1 and 4 have been folded over, to flaps 11*a* provided on section 4. Such a prebonded, flat blank where adhesive tab 5 is bonded to section 1 is characterized in that film tube portion 14 is only bonded to flaps 11*a* and 11*b* by means of detachable adhesive patches.

When this prebonded blank is handled by a packaging machine, it is first of all erected. On account of the adhesive connections provided on adhesive patches 15, the simultaneous erection of the film tube portion positioned in the cardboard sleeve made from the blank does here not present any difficulties. Subsequently, film tube portion 14 is first removed at one side of the erected blank from flaps 11*a* and 11*b*, e.g. the flaps shown at the left side in FIG. 4, and sealed in the area of its cutting edge 17 located there, whereupon the film tube portion is folded into the folding box and the above-mentioned flaps 11*a*, 11*b*, as well flaps 12 and 13 adjacent thereo are folded over and bonded to one another. A gore of the inner bag which is first only sealed at one side may be partly folded between the flaps in a way comparable with that shown in the first embodiment, and in accordance with FIGS. 2 and 3. This feature, however, can also be dispensed with so that the inner bag is freely movable in the finished, completly closed packaging, which particularly facilitates the separate disposal of carton and inner bag after use of the packaging.

After the film tube portion and folding box have been closed at one side, the film tube portion in the folding box can be filled from the other side which is still open. Adhesive patches 15 which are still effective there and provided on flaps 11*a* and 11*b* help to keep the film tube portion open. Subsequently, the last-mentioned adhesive patches are also detached, the film tube portion is closed and folded in for forming a completely closed inner bag in the area of cutting edge 18, whereupon the folding box is entirely closed at the side which is the right one in FIG. 4 by folding over flaps 11*a*, 11*b*, 12 and 13 and by bonding the same to one another.

It goes without saying that the last-mentioned technique may also be employed in the case of the first-mentioned embodiment if there is no bonding of the inner bag to the folding box in the area of the withdrawal nozzle.

Apart from this, the features of the embodiment illustrated in FIG. 4 correspond to those of FIG. 1; that is why they have been provided with identical reference numerals in the drawing and need here not be explained again.

We claim:

1. A substantially flat assembly for making a three-dimensional cardboard package for liquids including a cardboard box blank having fold lines defining walls of a cardboard box to be erected and a plurality of connecting flaps, an inner bag of flexible thermoplastic material, and a spout for withdrawing liquid from the package, said spout extending through an aperture in one of said walls of the box blank, said bag being securely bonded to the one wall containing said aperture, the improvement comprising attachment means on one or more of said flaps for detachably connecting the inner bag thereto while the box blank is being erected to form the three-dimensional package and thereafter when the box is fully erected being capable of releasing the inner bag from the flaps to permit the bag to collapse, said attachment means including apertures in said flaps connectable to a vacuum source of a box erecting machine.

2. The assembly of claim 1 wherein said attachment means further comprises glue coated on portions of said flaps.

3. A disposable package for liquids comprising:

an outer cardboard box formed from a cardboard box blank, said blank having fold lines defining a plurality of rectangular box walls, said blank also having a plurality of connecting flaps defined by additional fold lines, said connecting flaps being foldable against adjacent box walls and/or associated other ones of said flaps, one of said box walls having an aperture therethrough;

an inner bag disposed within said cardboard box, said bag having collapsible sidewalls formed from a tube of flexible material, said tube having a pair of spaced transverse seams extending substantially orthogonally to the one box wall having an aperture therein, the distance between said spaced seams being greater than the width of the one box wall, said transverse seams defining a first pair of gores adjacent said one box wall and a second pair of gores adjacent an opposed box wall;

said first pair of gores being folded over a respective pair of box walls adjacent to said one box wall and being secured against said pair of walls and clamped between associated ones of said connecting flaps folded against said pair of walls;

said second pair of gores being folded into regions within said box and being unattached to said box;

attachment means for bonding a sidewall portion of said inner bag which has no seams therein to only said one box wall, the remaining sidewall portions of said bag being unattached to said box walls; and a spout for withdrawing liquid from the package, said spout extending through the aperture in said one of the box walls and being sealed to the sidewall portion of the inner bag which is bonded to said one box wall.

4. The package of claim 3 wherein said inner bag is formed from a seamless, extruded tube of material.

5. The package of claim 3 wherein said inner bag is formed from a tube having one or more longitudinal welded seams substantially perpendicular to said spaced transverse seams.

6. The pre-bonded blank assembly of claim 3 wherein said inner bag is formed from a seamless, extruded tube of material.

7. The pre-bonded blank assembly of claim 3 wherein said inner bag is formed from a tube having one or more longitudinal welded seams substantially perpendicular to said spaced transverse seams.

8. A pre-bonded blank assembly for forming a disposable package for liquids comprising:

a cardboard blank having fold lines defining a plurality of rectangular box walls of a cardboard box to be erected, said blank also having a plurality of connecting flaps defined by additional fold lines, said connecting flaps being foldable against adjacent box walls and/or associated other ones of said flaps, one of said box walls having an aperture therethrough;

an inner bag to be disposed within said erected cardboard box, said bag having collapsible sidewalls formed from a tube of flexible material, said tube having a pair of spaced transverse seams extending substantially orthogonally to the one box wall having an aperture therein, the distance between said spaced seams being greater than the width of the one box wall, said transverse seams defining a first pair of gores to be disposed adjacent said one box wall of the erected box and a second pair of gores to be disposed adjacent an opposed box wall of the erected box;

said first pair of gores being foldable over a respective pair of box walls adjacent to said one box wall when the blank is erected to form a box and being secured against said pair of walls and clampable between associated ones of said connecting flaps folded against said pair of walls;

said second pair of gores being foldable into regions within said box and being unattached to said box when said blank is erected to form a box; and attachment means for bonding a sidewall portion of said inner bag which has no seams therein to the blank at only said one box wall, the remaining sidewall portions of said bag being unattached to said box walls.

9. A method of making a three-dimensional cardboard package for liquids comprising the steps of:

providing a cardboard box blank having fold lines defining walls of a cardboard box to be erected and a plurality of connecting flaps;

providing an inner sleeve of flexible thermoplastic material and a spout for withdrawing liquid from the package;

forming a hole in one of said walls of the cardboard blank;

forming one or more holes in said connecting flaps;

inserting the spout through the hole in one of said walls and securely bonding the inner bag portions surrounding the spout to the one wall;

detachably connecting other portions of the inner bag to one or more of said flaps by applying suction through said one or more holes in the flaps;

erecting the cardboard box blank into a three-dimensional box by folding the box walls and flaps about the fold lines while continuing to apply said suction; and releasing the inner bag portions from the flap or flaps once the box blank is fully erected into a three-dimensional box by stopping the application of said suction.

10. The method of claim 9 wherein said step of detachably connecting is further performed by applying releasable glue to portions of said flap or flaps.

11. A method for making a disposable package for liquids comprising the steps of:

providing a box blank having fold lines defining a plurality of rectangular box walls of a box to be erected from said blank, said blank also having a plurality of connecting flaps defined by additional fold lines, said connecting flaps being foldable against adjacent box walls and/or associated other ones of said flaps, one of said box walls having an aperture therethrough;

providing an inner bag to be disposed within said box, said bag having collapsible sidewalls formed from a tube of flexible material;

bonding a portion of said tube which has no seams therein to only said one box wall, the remaining portions of said tube being unattached to said box walls;

erecting the box blank to form the box and expanding the said tube therewith, introducing a spout for withdrawing liquid from the package, through one of said ends into said tube and inserting said spout through an opening in said tube portion bonded to said one box wall and through said aperture in said one box wall and sealing the spout to the tube portion which is bonded to said one box wall;

sealing the tube at said both ends by transverse seams, said seams defining a first pair of gores adjacent said one box wall and a second pair of gores adjacent an opposite box wall;

folding the first pair of gores over a respective pair of box walls adjacent to said one box wall, and securing said first pair of gores against said pair of walls by clamping said pair of gores between associated ones of said connecting flaps folded against said pair of walls; and folding said second pair of gores into regions within said box and leaving said second pair of gores unattached to said box.

* * * * *